US005256084A

United States Patent [19]

Kodama

[11] Patent Number: 5,256,084

[45] Date of Patent: Oct. 26, 1993

[54] CONNECTOR

[75] Inventor: Shinji Kodama, Shizuoka, Japan

[73] Assignee: Yazaki Corporation, Tokyo, Japan

[21] Appl. No.: 961,877

[22] Filed: Oct. 16, 1992

[30] Foreign Application Priority Data

Oct. 18, 1991 [JP] Japan ..... 3-85084[U]

[51] Int. Cl.[5] ..... H01R 13/40

[52] U.S. Cl. ..... 439/595; 439/752

[58] Field of Search ..... 439/595, 597-599, 439/752

[56] References Cited

U.S. PATENT DOCUMENTS

| | | | |
|---|---|---|---|
| 4,867,712 | 9/1989 | Kato et al. | 439/752 |
| 4,944,690 | 7/1990 | Tsuji et al. | 439/595 |
| 4,975,082 | 12/1990 | Nagasaka et al. | 439/595 |
| 5,066,252 | 11/1991 | Kato et al. | 439/752 |
| 5,088,938 | 2/1992 | Murakami et al. | 439/595 |
| 5,108,310 | 4/1992 | Sawada et al. | 439/595 |
| 5,176,537 | 1/1993 | Samejima et al. | 439/598 |

FOREIGN PATENT DOCUMENTS 3-1463 1/1991 Japan .

*Primary Examiner*—Paula A. Bradley

*Attorney, Agent, or Firm*—Sughrue, Mion, Zinn, Macpeak & Seas

[57] ABSTRACT

There is disclosed a connector in which metal terminals are received and retained in terminal receiving chambers of a housing, respectively, and when withdrawing the terminal, an electrical contact portion of the terminal is prevented from a scratch and deformation. The connector includes a connector housing having terminal receiving chambers, metal terminals for being received respectively into the terminal receiving chambers, and a terminal fixing member connectable to a front portion of the connector housing in a two-stage manner, that is, in a provisionally-locked condition and a completely-locked condition. A first retaining projection engageable with a rear shoulder of an electrical contact portion of the metal terminal inserted into a regular position is formed on one of opposed inner walls of each of the terminal receiving chamber, whereas a flexible arm for urging the electrical contact portion toward the one inner wall is formed on the other inner wall. A retainment release window which is opened in the provisionally-locked condition of the terminal fixing member is formed forwardly of the one inner wall. A flexible terminal protection piece for covering the electrical contact portion is provided in the retainment release window.

6 Claims, 5 Drawing Sheets

CONNECTOR

BACKGROUND OF THE INVENTION

This invention relates to a connector which is used for connecting a wire harness or the like, and is so designed as to prevent an electrical contact portion of a metal terminal, inserted and retained in the connector, from being damaged or deformed when withdrawing the metal terminal from the connector.

Generally, a retaining means for preventing a rearward withdrawal of a metal terminal inserted into a terminal receiving chamber of a connector housing is provided between this receiving chamber and the metal terminal. In order to increase the retaining force and to secure a more stable electrical connection, a terminal fixing member separate from the housing has been used to achieve a double-retainment of the metal terminal.

There has been proposed a connector of such a double-retainment construction as shown in FIGS. 4 to 7 (Japanese Laid-Open Patent Application No. 3-1463). In these Figures, reference character A denotes a male connector housing of a synthetic resin, reference numeral B a terminal fixing member connected to the front portion of this housing, and reference character C a metal terminal.

The housing A is adapted to be fitted in its mating female connector housing (not shown), and has a lock arm 1 and a waterproof hood 2 at its outer peripheral portion. A waterproof packing 3 is provided between the hood 2 and the outer peripheral portion (see FIG. 6).

Provided within the housing A are a pair of right and left terminal receiving chambers 4 and 4 disposed side by side, and a suitable gap V is formed between opposed side walls 5 and 5 of the two chambers. As shown in FIG. 6, a first retaining projection 8 is formed on a central portion of an upper wall 6 of the terminal receiving chamber 4, and a flexible arm 9 extending in opposed relation to the projection 8 is formed on a bottom wall 7 of the chamber 4. A front half portion of the upper wall 6 adjacent to the retaining projection 8 is removed to provide a retainment release window 10.

The terminal fixing member B includes a provisional lock plate 12 for the housing A, a flexible terminal retaining plate 13 for the metal terminal C, and a top plate 14 for closing the window 10. More specifically, in the terminal fixing member B, the flexible terminal retaining plate 13 extends forwardly from a horizontal base plate portion 15 in parallel relation thereto, and the provisional lock plate 12 to be inserted into the gap V is formed upright on the central portion, and the top plate 14 is formed on the proximal end portion of the plate 12 in parallel relation to the base plate portion 15. The provisional lock plate 12 has at its free end lock pawls 12*a* engageable respectively with the side walls 5 of the terminal receiving chambers 4. The flexible terminal retaining plate 13 has second retaining projections 13*a*.

Reference numerals 14*a* and 15*a* denote stoppers, respectively, and the stopper 14*a* prevents a forward withdrawal of the metal terminal C, and the stopper 15*a* limits the degree of insertion of the terminal fixing member B into the terminal receiving chambers 4.

In the above connector, when the metal terminal C is in its regular position, that is, completely inserted into the terminal receiving chamber 4 as shown in FIG. 6, the first retaining projection 8 engages a rear shoulder 18 of an electrical contact portion $C_1$, and at the same time the flexible arm 9 urges the metal terminal C against the upper wall 6, thereby achieving a primary retainment. The retaining projection 13*a* of the flexible terminal retaining plate 13 of the terminal fixing member 13 attached to the housing A from the front side of this housing is engaged in a retaining hole 17 in a base plate portion 16 of the metal terminal C. As a result, the metal terminal C is retained in a double manner, and the terminal fixing member B is completely locked.

When the provisional lock plate 12 of the terminal fixing member B is inserted into the gap V, with the metal terminal C not inserted in the terminal receiving chamber 4, the lock pawls 12*a* are engaged respectively with the side walls, so that the terminal fixing member B is provisionally locked relative to the housing A. Then, during the insertion of the metal terminal C, the distal end of the electrical contact portion $C_1$ impinges on the distal end of the flexible terminal retaining plate 13, so that part of the terminal fixing member B is forced out of the terminal receiving chamber 4. When the metal terminal C further moves into the above-mentioned regular position, a space into which the flexible terminal retaining plate 13 can be inserted is formed between the metal terminal C and the bottom wall 7, and therefore by again pushing the terminal fixing member B, the completely-locked condition is obtained as described above.

In the above connector, when the metal terminal C inserted and retained in the terminal receiving chamber 4 of the housing A is to be withdrawn therefrom, part of the completely-locked terminal fixing member B is pulled out to open the retainment release window 10, as shown in FIG. 7(A), and then a metal pin 20 of a terminal withdrawal jig is inserted through this open window to directly urge the electrical contact portion $C_1$ toward the bottom wall 7 to flex the flexible arm 9, thereby releasing the engagement between the first retaining projection 8 and the rear shoulder 18, as shown in FIG. 7(B), and then the metal terminal C is pulled out in a direction of arrow as shown in FIG. 7(C).

Since the pin 20 is thus contacted directly with the metal terminal C, the metal terminal is susceptible to a scratch. And besides, since the size of the terminal receiving chamber as well as the size of the metal terminal C is small, the operation can not be carried out easily, so that an excessive force is liable to be applied, which results in a drawback that the electrical contact portion $C_1$ is deformed to be unusable.

SUMMARY OF THE INVENTION

With the above problems in view, it is an object of this invention to provide a connector of the type which eliminates the risk of damaging or deforming an electrical contact portion of a metal terminal when withdrawing the metal terminal.

The above object has been achieved by a connector comprising a connector housing having terminal receiving chambers, metal terminals for being received respectively into said terminal receiving chambers, and a terminal fixing member connectable to a front portion of said connector housing in a two-stage manner, that is, in a provisionally-locked condition and a completely-locked condition; wherein a first retaining projection engageable with a rear shoulder of an electrical contact portion of the metal terminal inserted into a regular position is formed on one of opposed inner walls of each of the terminal receiving chamber, whereas a flexible arm for urging the electrical contact portion toward the one inner wall is formed on the other inner wall; a retainment release window which is opened in the provisionally-locked condition of said terminal fixing member is formed forwardly of said one inner wall; and a flexible terminal protection piece for covering the electrical contact portion is provided in the retainment release window.

The flexible terminal protection piece is provided in the retainment release window at the front side of the terminal receiving chamber, and therefore when withdrawing the terminal, a metal pin of a terminal withdrawal jig will not be contacted directly with the electrical contact portion, but the electrical contact portion is urged through the protection piece, and therefore is prevented from being scratched and deformed.

DESCRIPTION OF THE PREFERRED EMBODIMENTS

Figure 1:
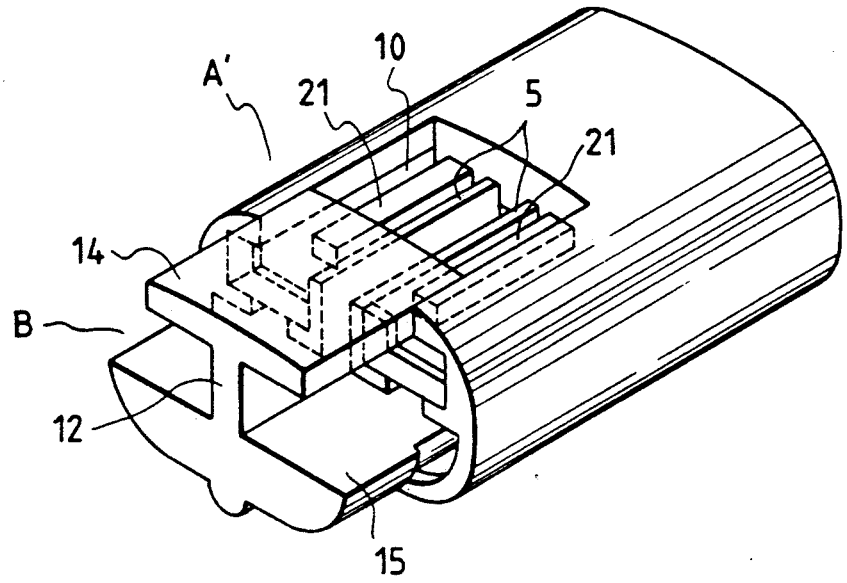
FIG. 1 is a perspective view showing an important portion of a preferred embodiment of a connector of the present invention.
Figure 2A:
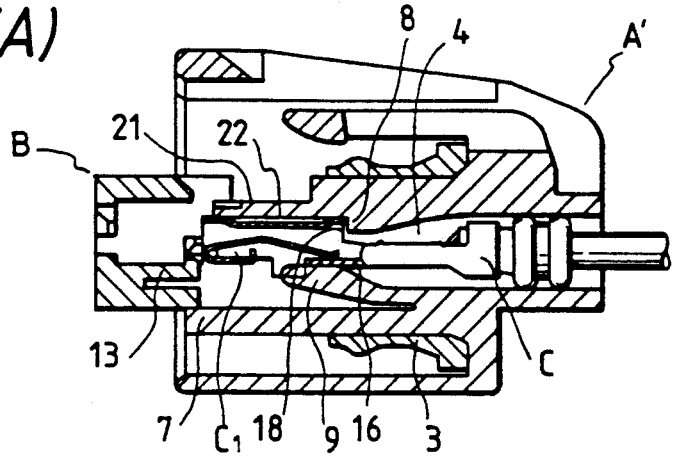
FIGS. 2(A) to 2(C) are cross-sectional views showing the process of withdrawal of a metal terminal.
Figure 2B:
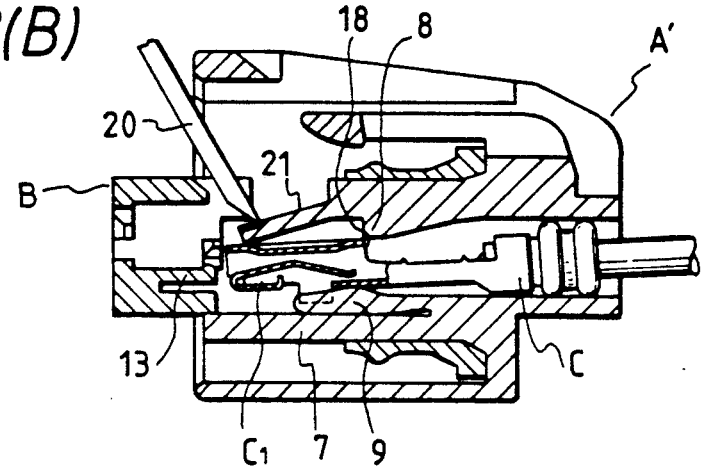
Figure 2C:
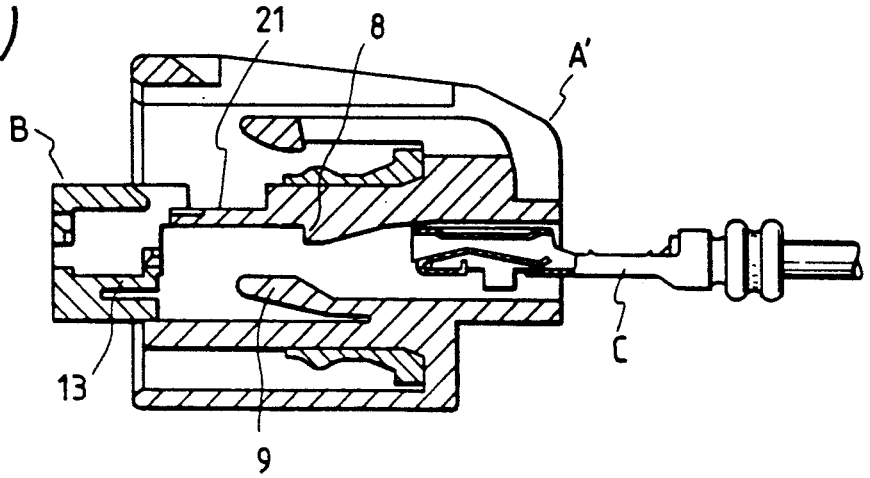
Figure 4:
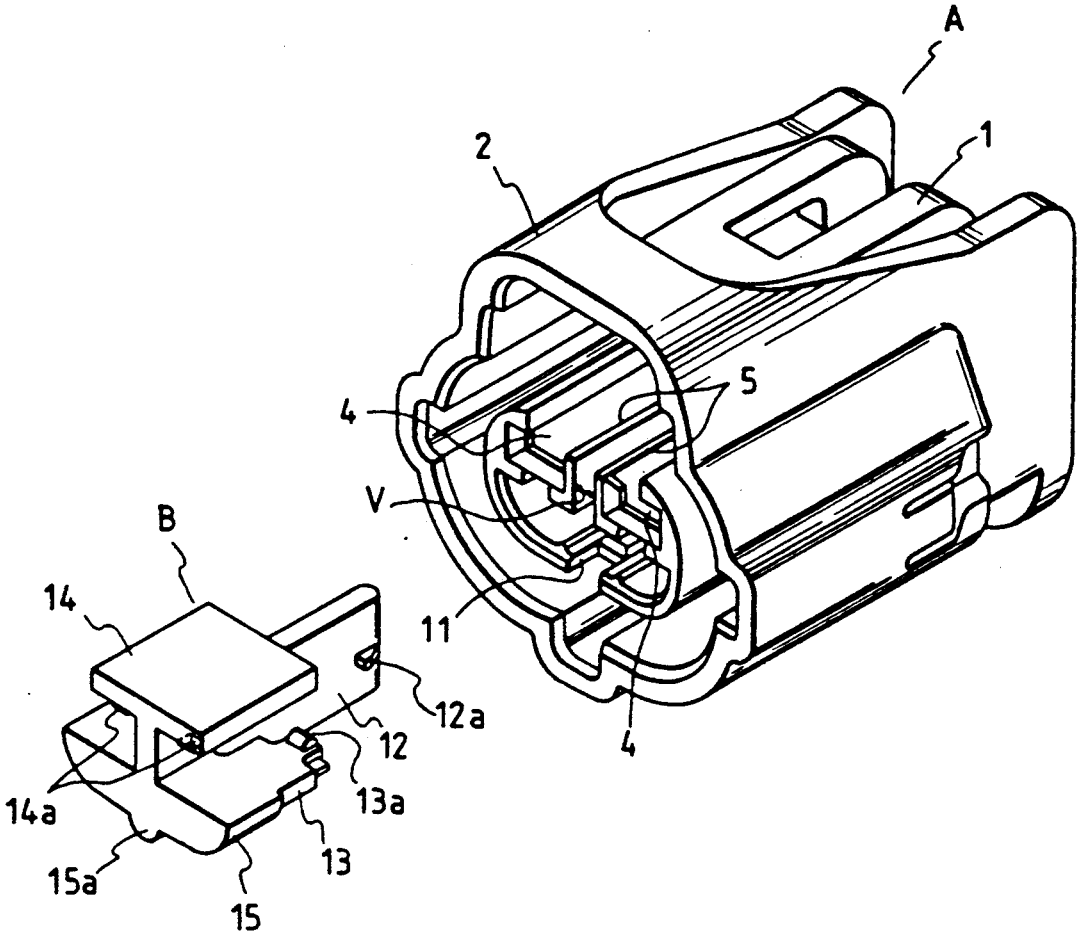
FIG. 4 PRIOR ART
FIG. 4 is a perspective view of a conventional example, showing a connector housing and a terminal fixing member separated therefrom.
Figure 5:
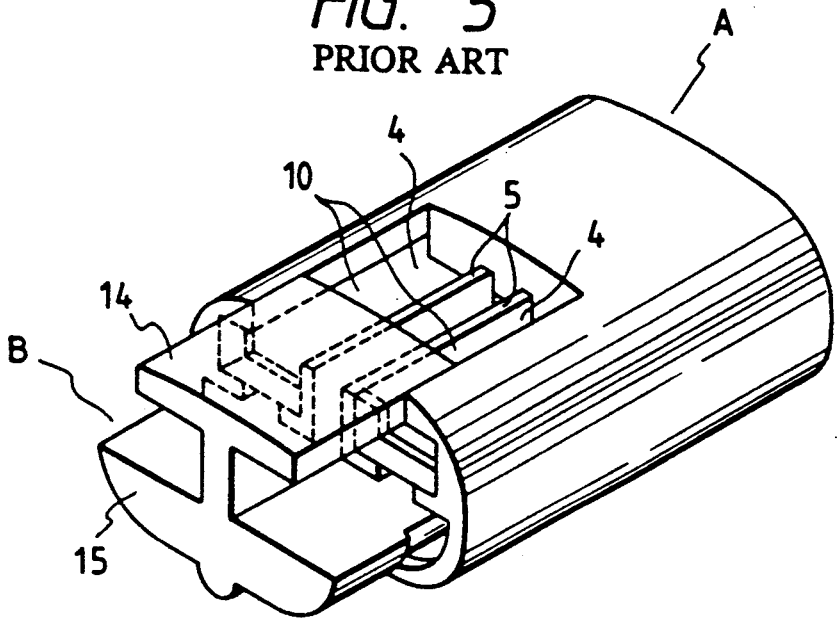
FIG. 5 PRIOR ART
FIG. 5 is an enlarged perspective view of an important portion, showing the terminal fixing member of FIG. 4 in its connected condition.
Figure 6:
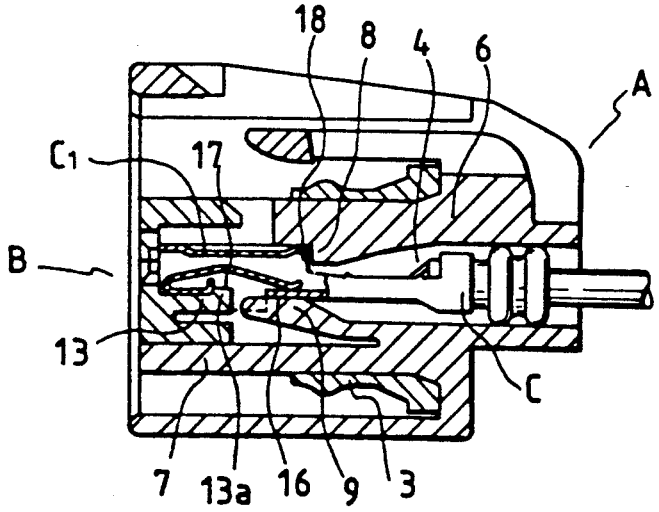
FIG. 6 PRIOR ART
FIG. 6 is a cross-sectional view showing a double-retained condition of a metal terminal in FIG. 4.
Figure 7A:
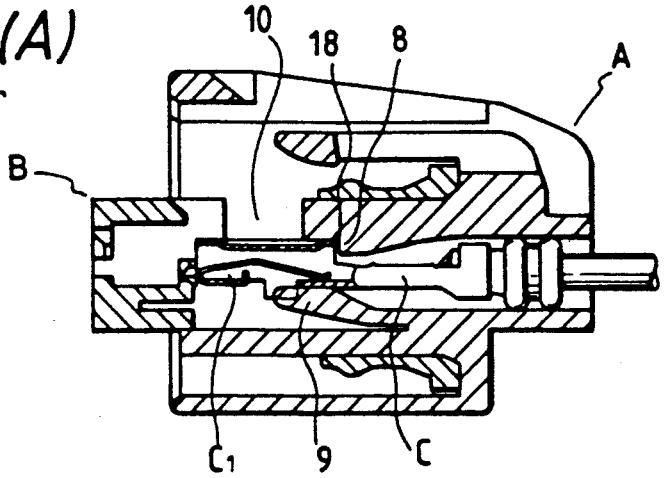
FIG. 7(A) PRIOR ART
FIGS. 7(A) to 7(C) are cross-sectional views showing the process of withdrawal of the metal terminal of FIG. 6.
Figure 7B:
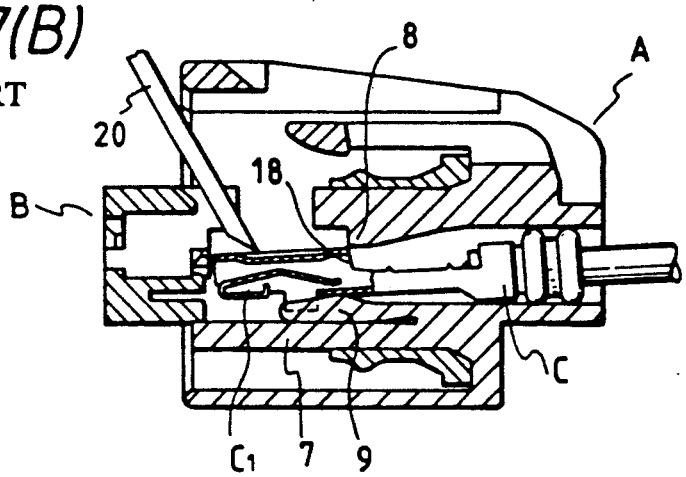
FIG. 7(B) PRIOR ART
Figure 7C:
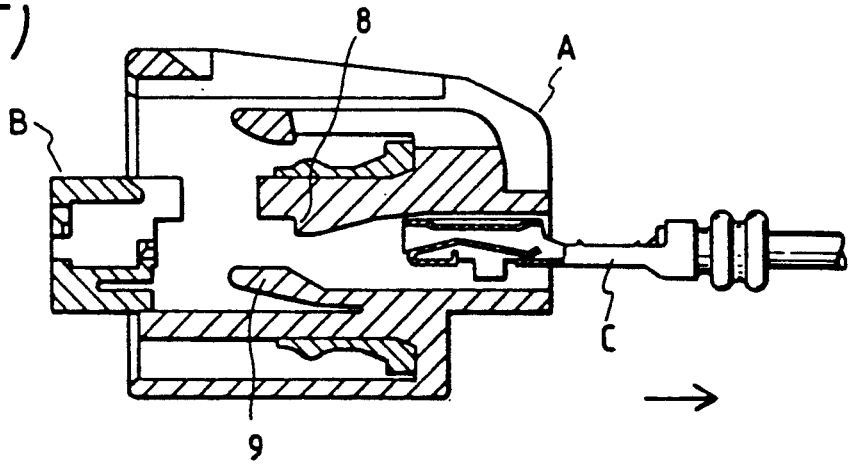
FIG. 7(C) PRIOR ART

FIG. 1 is a perspective view of one preferred embodiment of a connector of the present invention, and FIGS. 2(A) to 2(C) are cross-sectional views showing the operation of the connector. Those portions in these Figures which are identical in construction to those of the conventional example are designated by identical reference numerals, respectively, and explanation thereof will be omitted.

In a male connector housing A' shown in FIG. 1, a flexible terminal protection piece 21 is provided in a retainment release window 10 provided at a front portion of each of terminal receiving chambers 4 and 4, and except for this, this housing is of the same construction as the housing shown in FIGS. 4 to 7. A terminal fixing member B and a metal terminal C are also the same as the conventional ones, respectively.

In the present invention, even when part of the terminal fixing member B is withdrawn after a complete locking thereof is released from a double-retained condition of the metal terminal C (see FIG. 6), the terminal protection piece 21 covers an upper surface 22 of an electrical contact portion $C_1$, as shown in FIG. 2(A).

Therefore, when a metal pin 20 of a terminal withdrawal jig is inserted and pushed as shown in FIG. 2(B), the electrical contact portion $C_1$ is urged toward a bottom wall 7 through the terminal protection piece 21, so that the engagement between a first retaining projection 8 and a rear shoulder 18 is released, and therefore the metal terminal C can be withdrawn as shown in FIG. 2(C). Therefore, there is no risk that the electrical contact portion $C_1$ is subjected to a scratch and deformation.

Figure 3:
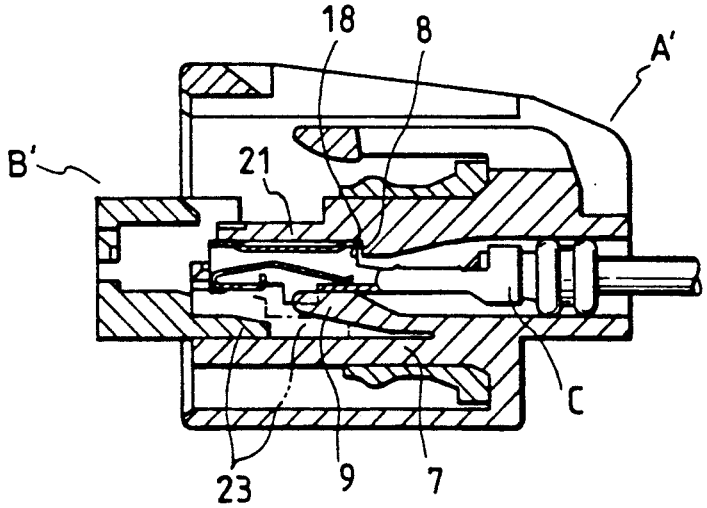
FIG. 3 is a cross-sectional view of another embodiment of the invention.

FIG. 3 shows another embodiment of the present invention in which part of the terminal fixing member is modified. This terminal fixing member B' has a flexure prevention plate 23 for a flexible arm which replaces the flexible terminal retaining plate 13 having the second retaining projections 13*a*.

In a primarily-retained condition of the metal terminal C, the flexure prevention plate 23 is inserted into a space between the flexible arm 9 and the bottom wall 7 as indicated in double dotted chain line to prevent this arm 9 from being flexed, thereby increasing the retaining force for the metal terminal C to achieve an effect similar to the double retainment. The terminal can be withdrawn in the same manner as described above.

As described above, in the present invention, when the metal terminal is to be withdrawn from the connector, the electrical contact portion will not be contacted directly with the terminal withdrawal jig because of the provision of the flexible terminal protection piece. Therefore, an improper contact of the metal terminal with its mating terminal because of a scratch, as well as the unusability of the terminal because of its deformation, is eliminated.

What is claimed is:

1. A connector comprising a connector housing having terminal receiving chambers, metal terminals for being received respectively into said terminal receiving chambers, and a terminal fixing member connectable to a front portion of said connector housing in a two-stage manner, that is, in a provisionally-locked condition and a completely-locked condition;

wherein a first retaining projection engageable with a rear shoulder of an electrical contact portion of said metal terminal inserted into a regular position is formed on one of opposed inner walls of each of said terminal receiving chamber, whereas a flexible arm for urging said electrical contact portion toward said one inner wall is formed on the other inner wall; a retainment release window which is opened in the provisionally-locked condition of said terminal fixing member is formed forwardly of said one inner wall; and a flexible terminal protection piece for covering said electrical contact portion is provided in said retainment release window.

2. The connector according to claim 1, wherein said protection piece is formed on said connector housing.

3. The connector according to claim 1, further comprising:

a terminal fixing member attached to said connector housing for preventing said metal terminal, which is inserted into and retained in said connector housing, from being displaced in said second direction.

4. The connector according to claim 1, further comprising:

a terminal fixing member attached to said connector housing and engageable with said metal terminal inserted into and retained in said connector housing.

5. The connector according to claim 1, further comprising:

a terminal fixing member adapted to be retained in a first position and a second predetermined position relative to said connector housing, and wherein said terminal fixing member in said first position allows said metal terminal to be displaced in said second direction and said terminal fixing member in said second predetermined position covers said protection piece and prevents said metal terminal from being displaced in said second direction.

6. A connector comprising:

a connector housing;

at least one metal terminal inserted into said connector housing;

retaining means for retaining said metal terminal inserted into said connector housing in place by urging said metal terminal in a first direction against said connector housing; and a protection piece extending along said metal terminal inserted into and retained in said connector housing, and wherein:

said metal terminal inserted into and retained in said connector housing is operatively urged in a second direction opposite to said first direction through said protection piece so that said metal terminal is permitted to be removed from said connector housing.

* * * * *